US006456248B2

(12) United States Patent
Ito

(10) Patent No.: US 6,456,248 B2
(45) Date of Patent: Sep. 24, 2002

(54) ANTENNA DEVICE AND PORTABLE WIRELESS COMMUNICATION APPARATUS

(75) Inventor: Hiroki Ito, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/836,092

(22) Filed: Apr. 17, 2001

(30) Foreign Application Priority Data

Apr. 20, 2000 (JP) ..... 2000-119924

(51) Int. Cl.[7] ..... H01Q 1/24
(52) U.S. Cl. ..... 343/702; 343/846
(58) Field of Search ..... 343/702, 700 MS, 343/841, 846, 848, 829

(56) References Cited

U.S. PATENT DOCUMENTS 5,943,020 A * 8/1999 Liebendoerfer et al. .... 343/702

6,008,764 A * 12/1999 Ollikainen et al. .. 343/700 MS

* cited by examiner

*Primary Examiner*—Don Wong
*Assistant Examiner*—Hoang Nguyen
(74) *Attorney, Agent, or Firm*—Jay H. Maioli

(57) ABSTRACT

An antenna device and a portable wireless communication apparatus lower a local average specific absorption rate (SAR) in correspondence to at least two or more kinds of radio communication systems using different radio communication frequencies even when any radio communication frequency is used. Input impedance at open ends of conductive planar plates are brought close to infinity at first and second radio communication frequencies and restrict emission of electromagnetic waves by restricting a high-frequency current to be supplied to the above described conductive plates and a shield case, thereby securely lowering the local average SAR in correspondence to at least two or more kinds of radio communication systems using different radio communication frequencies even when any radio communication frequency is used.

11 Claims, 3 Drawing Sheets

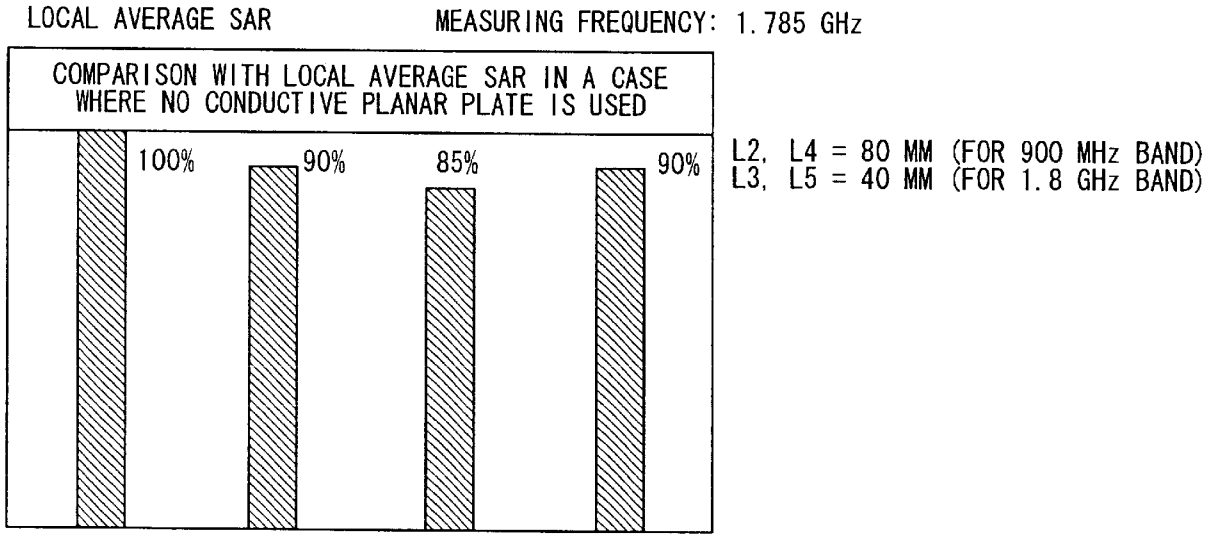
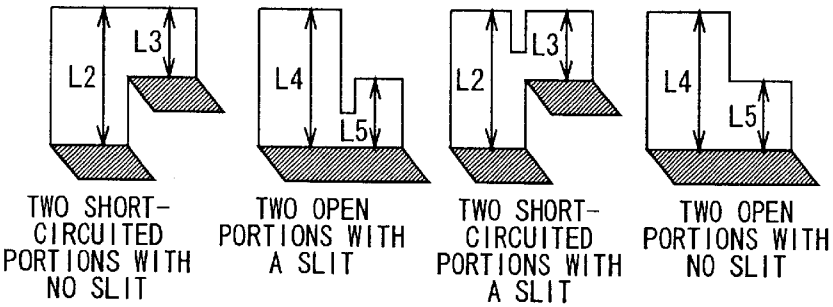
FIG. 5A FIG. 5B FIG. 5C FIG. 5D

ANTENNA DEVICE AND PORTABLE WIRELESS COMMUNICATION APPARATUS

BACKGROUND OF THE INVENTION

1. Field of the Invention

The present invention relates to an antenna device and a portable wireless communication apparatus, and more particularly, is suitably applicable, for example, to a portable wireless communication apparatus which is configured to correspond to at least two kinds of radio communication systems using different radio communication frequencies.

2. Description of the Related Art

As portable wireless communication apparatuses have rapidly prevailed in recent years, only a single radio communication system tends to be incapable of providing a sufficient number of circuits. It is therefore conceived to reserve a necessary number of circuits by using another radio communication system which uses a different frequency bands and, owing to remarkable progresses made in a technology for compact and light-weight configurations, there has been developed a terminal which allows a single portable wireless communication apparatus to use two kinds of radio communication systems.

On the other hand, an amount of electromagnetic waves to be absorbed by specific regions of a human body (mainly a head) per unit time and unit mass out of electromagnetic waves emitted from a portable wireless communication apparatus is defined as an average local Specific Absorption Rate (SAR) of the portable wireless communication apparatus and it is demanded to restrict a maximum value of this SAR to a specified value or lower.

In FIG. 1, reference numeral 1 denotes a portable wireless communication apparatus which is developed so as to suppress a maximum value of the local average SAR to a specified value or lower as a whole. In the Figure, a circuit substrate (not shown) required for radio communication is accommodated in a cabinet (not shown) made of a non-conductive material and covered with a shield case 2 used as a ground member.

Since the internally accommodated circuit substrate is covered with the shield case 2, this portable wireless communication apparatus 1 prevents a transmitting-receiving circuit and other various kinds of circuits mounted on the circuit substrate from producing adverse influences on one another, an antenna 4 and other appliances.

Furthermore, the internal circuit substrate is configured to generate a transmitting-receiving signal of a predetermined format with the transmitting-receiving circuit for communication with a base station, transmit the signal from the antenna 4 to the base station by way of an antenna power supply portion 3, and demodulate a reception signal which is received with the antenna 4 and accepted by way of the antenna power supply portion 3.

The antenna 4 is, for example, a bar like rod antenna which is made of a conductive wire material, but the portable wireless communication apparatus is configured to be capable of using other various types of antennas such as a helical antenna which is made of a conductive wire material wound in a spiral form and an expansion type antenna which is a composite type of the rod antenna and the helical antenna.

Only the above described antenna 4 does not function as an antenna, but a high-frequency current is supplied also into a ground conductor of the circuit substrate or the shield case 2, whereby the portable wireless communication apparatus 1 as a whole functions as an antenna.

The portable wireless communication apparatus 1 is configured to measure the local average SAR during communication and it has been confirmed that a spot at which the local average SAR has a maximum value (hereinafter referred to as a hot spot) is in the vicinity of an ear which is in contact with a speaker 7 as shown in FIG. 2.

A reason is considered that the portable wireless communication apparatus 1 is used in a condition where the speaker 7 is kept in contact with an ear of a human body during communication and the ground conductor of the circuit substrate existing on a rear side of the speaker 7 or the shield case 2 which functions as a portion of the antenna emits electromagnetic waves.

The portable wireless communication apparatus 1 (FIG. 1) therefore has a conductive planar plate 5 disposed at a location which is opposed to the speaker 7 (not shown) and slightly floated from a top surface 2A of the shield case 2 so as to be nearly in parallel with the top surface 2A.

By the way, a gap between the conductive planar plate 5 and the top surface 2A of the shield case 2 is determined dependently on radio communication frequencies and the portable wireless communication apparatus 1 is configured to be capable of adjusting a frequency bandwidth dependently on the above described gap.

An end of the conductive planar plate 5 is short-circuited to the shield case 2 by a short-circuiting conductor 6, the other end of the conductive planar plate 5 is electrically open from the shield case 2 upward in a direction indicated by an arrow a and a distance L1 from the short-circuited end to the open end is selected so as to be a wavelength $\lambda$ at a radio frequency/4.

Accordingly, impedance between the conductive planar plate 5 and the shield case 2 of the portable wireless communication apparatus 1 is nearly "0" at the short-circuited end but close to infinity at the open end, whereby the high-frequency current is hardly supplied from the vicinity of the antenna power supply portion 3 to the conductive planar plate 5 and the shield case 2.

By the way, it has experimentally proved that input impedance is 0 at the short-circuited end and input impedance is a maximum at the open end when the distance L1 as measured from the short-circuited end to the open end of the conductive planar plate 5 is selected as the wavelength $\lambda$ at the radio communication frequency/4, and that input impedance is 0 at the open end when the distance L1 as measured from the short-circuited end to the open end is selected as the wavelength $\lambda$ at the radio communication frequency/2.

Accordingly, the portable wireless communication apparatus 1 makes the high-frequency current hardly supplied to the conductive planar plate 5 and the shield case 2, thereby being capable of reducing an amount of electromagnetic waves emitted from the conductive planar plate 5 and the shield case 2, and lowering the local average SAR in the vicinity of the ear.

In the portable wireless communication apparatus 1 having the configuration described above, however, the distance L1 from the short-circuited end to the open end of the conductive planar plate 1 is determined by a radio communication frequency to be used, and even when the distance L1 from the short-circuited end to the open end of the conductive planar plate 5 is a wavelength $\lambda/4$ and impedance is maximum at the open end at a radio communication frequency of 900 MHz, for example, the length L1 from the short-circuited end to the open end of the conductive planar plate 5 corresponds to a wavelength $\lambda/2$ at a radio communication frequency of 1.8 GHz.

Accordingly, the portable wireless communication apparatus 1 allows impedance to be lowered at the open end of the conductive planar plate 5 and increases an amount of electromagnetic waves emitted from the conductive planar plate 5 and the shield case 2, thereby being incapable of lowering the local average SAR at the radio communication frequency of 1.8 GHz though the portable wireless communication apparatus 1 allows impedance to be maximum at the open end of the conductive planar plate 5 and reduces an emitted amount of the electromagnetic waves, thereby being capable of lowering the local average SAR in the vicinity of the ear at the radio communication frequency of 900 MHz.

Accordingly, it is difficult for the portable wireless communication apparatus 1 to lower the local average SAR with the conductive planar plate 5 in correspondence to two kinds of radio communication systems which use different radio communication frequencies.

SUMMARY OF THE INVENTION

In view of the foregoing, an object of this invention is to provide an antenna device and a portable wireless communication apparatus which are compact, simple in configurations and capable of reducing an amount of electromagnetic waves to be absorbed by a human body in correspondence to at least two or more kinds of radio communication systems which use different radio communication frequencies respectively even when any radio communication frequency is used.

The foregoing object and other objects of the invention have been achieved by the provision of an antenna device and a portable wireless communication apparatus. The antenna device functions as an antenna by supplying electric power to an antenna element from a power supply point and supplying high-frequency currents to grounding conductors from the power supply point, and comprises high-frequency current restricting means which comprises at least: a first conductive planar plate having a first short-circuit portion where one end is electrically short-circuited to the grounding conductors, and a first open end portion where the other end is electrically opened and is positioned to bring input impedance close to infinity at first radio communication frequencies; and a second conductive planar plate having a second short-circuit portion where one end is electrically short-circuited to the grounding conductors, and a second open end portion where the other end is electrically opened and is positioned to bring input impedance close to infinity at second radio communication frequencies, and the first conductive planar plate and the second conductive planar plate are composed as one unit.

Since the input impedance at the open ends of the conductive planar plates can be brought close to infinity at the plurality of radio communication frequencies respectively, it is possible to limit radiation of electromagnetic waves by restricting the high-frequency currents supplied to the above described conductive planar plates and grounding conductors, thereby securely reducing an amount of electromagnetic waves to be absorbed by a human body in correspondence to at least two or more radio communication systems which use different radio communication frequencies even when any radio communication frequency is used.

The nature, principle and utility of the invention will become more apparent from the following detailed description when read in conjunction with the accompanying drawings in which like parts are designated by like reference numerals or characters.

BRIEF DESCRIPTION OF THE DRAWINGS

In the accompanying drawings:

FIGS. 5A to 5D are schematic diagrams showing measured results of a local average SAR when conductive planar plates are used.

DETAILED DESCRIPTION OF THE EMBODIMENT

Preferred embodiments of this invention will be described with reference to the accompanying drawings:

(1) First Embodiment

Figure 1:
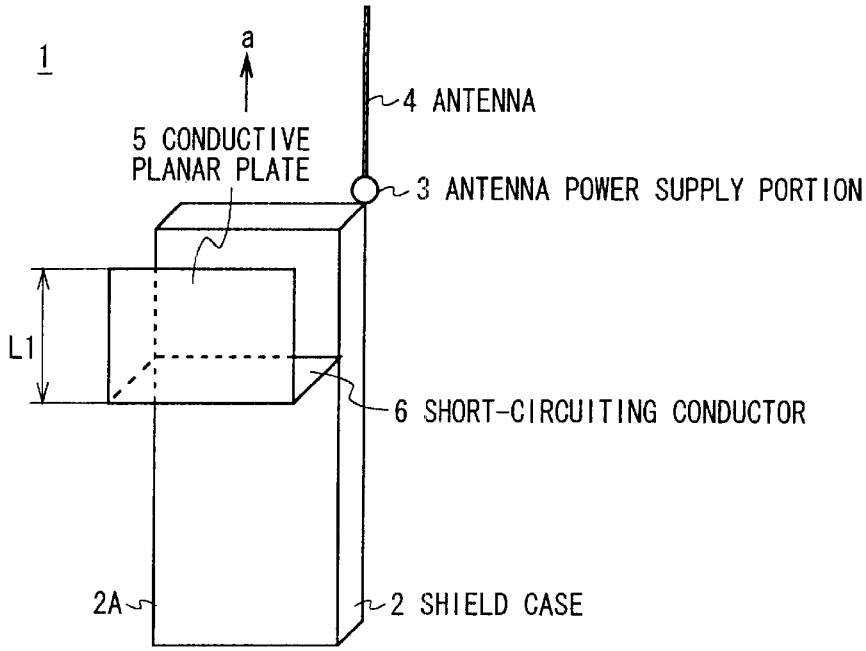
FIG. 1 (PRIOR ART)
FIG. 1 is a schematic perspective view showing a configuration of a conventional portable wireless communication apparatus.
Figure 2:
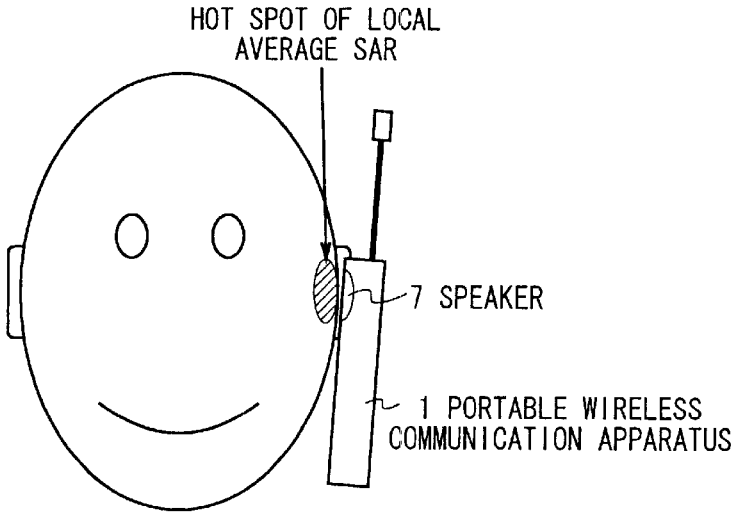
FIG. 2 (PRIOR ART)
FIG. 2 is a schematic diagram showing a hot spot of the local average SAR.
Figure 3:
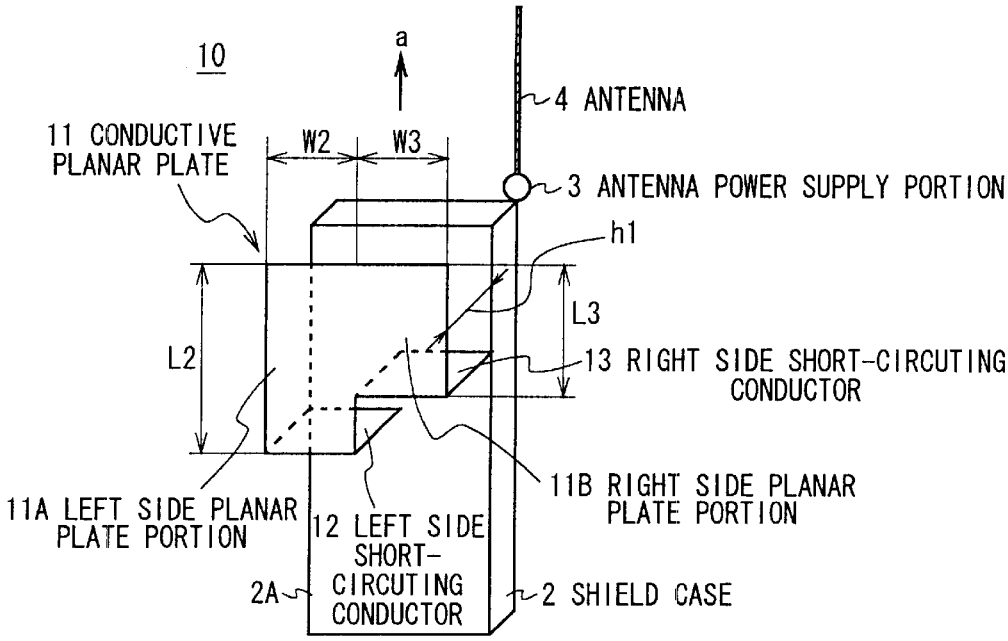
FIG. 3 is a schematic perspective view showing a configuration of a portable wireless communication apparatus according to a first embodiment of the present invention.

In FIG. 3 in which members corresponding to those shown in FIG. 1 are denoted by the same reference numerals, reference numeral 10 denotes a portable wireless communication apparatus as a whole according to a first embodiment of the present invention. A circuit substrate (not shown) required for carrying out radio communication is accommodated in a cabinet (not shown) made of a non-conductive material and covered with a shield case 2 used as a ground member.

Since the internally accommodated circuit substrate is covered with the shield case 2, the portable wireless communication apparatus 10 is configured so that a transmitting-receiving circuit and other various kinds of circuits mounted on the circuit substrate do not produce adverse influences on each other, an antenna 4 and other appliances.

Furthermore, the internal circuit substrate is configured to generate a transmission signal of a predetermined signal format with the transmitting-receiving circuit for communication with a base station, transmit this signal to the base station from the antenna 4 by way of an antenna power supply portion 3, and demodulate a reception signal received with the antenna 4 after receiving the reception signal by way of the antenna power supply portion 3.

The antenna 4 is composed of a bar like rod antenna made of a conductive wire material, and only the above described antenna 4 does not operate as an antenna but a high-frequency current is supplied also to the ground member or the shield case 2 from the antenna power supply portion 3, whereby the portable wireless communication apparatus 10 as a whole functions an antenna.

In this case also, description will be made below of the portable wireless communication apparatus 10 on an assumption that a hot spot at which the local average SAR has a maximum value is in the vicinity of an ear which is to be brought into contact with a speaker (not shown).

The portable wireless communication apparatus 10 has a conductive planar plate 11 disposed at a location which is nearly in parallel with a top surface 2A of the shield case 2 and at a height of h1 as measured from the above described top surface 2A, and the above described conductive planar plate 11 is short-circuited to the shield case 2 by a left side short-circuiting conductor 12 and a right side short-circuiting conductor 13.

The conductive planar plate 11 is configured as a single plate which consists of a rectangular left side planar plate portion 11A having a distance L2 as measured from a short-circuited end to an open end and a width W2 of the left side short-circuiting conductor 12, and a rectangular right side planar plate portion 11B having a distance L3 as measured from a short-circuited end to an open end and a width W3 of the right side short-circuiting conductor 13 which are joined nearly at a center.

The distance L2 as measured from the short-circuited end to the open end of the left side planar plate portion 11A of the conductive planar plate 11 is selected, for example, so as to be a wavelength at 900 MHz which is a first radio communication frequency λ/4.

Furthermore, the distance L3 as measured from the short-circuited end to the open end of the right side planar plate portion 11B of the conductive planar plate 11 is selected, for example, so as to be a wavelength at 1.8 GHz which is a second radio communication frequency λ/4.

Accordingly, the portable wireless communication apparatus 10 is capable of bringing input impedance at the open end of the above described conductive planar plate 11 close to infinity since the left side planar plate portion 11A of the conductive planar plate 11 functions at the first radio frequency (900 MHz).

Similarly, the portable wireless communication apparatus 10 is capable of bringing input impedance at the open end of the above described conductive planar plate 11 close to infinity since the right side planar plate portion 11B of the conductive planar plate 11 functions at the second radio frequency (1.8 GHz).

Though it has been experimentally proved that the input impedance at the open end is 0 when the distance L2 as measured from the short-circuited end to the open end is selected as a wavelength at the radio communication frequency λ/2, the distance L3 as measured from the short-circuited end to the open end of the right side planar plate portion 11B of the conductive planar plate 11 does not correspond to the wavelength λ/2 at the first radio frequency (900 MHz) and it is considered that nearly no influence is produced due to a function of the right side planar plate portion 11B at the first radio frequency.

However, the distance L2 as measured from the short-circuited end to the open end of the left side planar plate portion 11A of the conductive planar plate 11 corresponds to the wavelength λ/2 at the second radio frequency (1.8 GHz) and it is considered that the input impedance at the open end of the left side planar plate portion 11A is lowered, but since the distance L3 as measured from the short-circuited end to the open end of the right side planar plate portion lib is shorter than the distance L2 of the left side planar plate portion 11A, it is considered the right side planar plate portion 11B mainly functions and the left side planar plate portion 11A does not function so much.

The portable wireless communication apparatus 10 is configured to bring the input impedance at the open end of the conductive planar plate 11 close to infinity at the first radio frequency (900 MHz) and the second radio frequency (1.8 GHz) as described above, thereby making the high-frequency current hardly supplied from the antenna power supply portion 3 to the above described conductive planar plate 11 and the shield case 2, thereby reducing an amount of the electromagnetic waves emitted from the conductive planar plate 11 and the shield case 2, and being capable of lowering the local average SAR in the vicinity of a user's ear.

The portable wireless communication apparatus 10 having the above described configuration is capable of bringing the input impedance at the open end of the conductive planar plate 11 close to infinity at the first radio frequency and the second radio frequency since the conductive planar plate 11 which has the left side planar plate portion 11A which has the distance L2 as measured from the short-circuited end to the open end selected so as to be the wavelength λ at the first radio frequency (900 MHz)/4 and the right side planar plate portion 11B which has the distance L3 as measured from the short-circuited end to the open end selected so as to be the wavelength λ4 at the second radio frequency (1.8 GHz) is disposed at the location which is nearly in parallel with the top surface 2A of the shield case 2 and at the height of h1 as measured from the above described top surface 2A.

As a result, the portable wireless communication apparatus 10 is capable of reducing an amount of electromagnetic waves emitted from the conductive planar plate 11 and the shield case 2 at the first radio frequency and the second radio frequency, thereby lowering the local average SAR in the vicinity of an ear.

In a case where the local average SAR is measured at a measuring frequency of 1.785 GHz which is close to the second radio communication frequency as shown in FIG. 5A, the portable wireless communication apparatus 10 does not actually make the local average SAR higher than that in a case where the conductive planar plate 11 is not disposed.

That is, though the distance L2 as measured from the short-circuited end to the open end of the left side planar plate portion 11A of the conductive planar plate 11 corresponds to the wavelength λ/2 at the second radio frequency (1.8 GHz) in the portable wireless communication apparatus 10, the above described left side planar plate portion 11A scarcely functions and the portable wireless communication apparatus 10 is capable of maintaining the local average SAR which is equal to that when at least the conductive planar plate 11 is not disposed at the second radio communication frequency.

By the way, the left side planar plate portion 11A mainly functions and brings the input impedance at the open end close to infinity at the first radio communication frequency, whereby the portable wireless communication apparatus 10 is capable of reducing the amount of the electromagnetic waves emitted from the conductive planar plate 11 and the shield case 2, thereby securely lowering the local average SAR in the vicinity of the ear.

Furthermore, the portable wireless communication apparatus 10 can be configured compact and simple in a configuration without being complicated or enlarged since the portable wireless communication apparatus 10 uses the conductive planar plate 11 which is formed as the single plate consisting of the left side planar plate portion 11A and the right side planar portion 11B.

Owing to the above described configuration in which the left side planar plate portion 11A having the distance L2 as measured from the short-circuited end to the open end which is selected as the wavelength λ at the first radio frequency/4 and the right side planar plate portion 11B having the distance L3 as measured from the short-circuited end to the open end which is selected as the wavelength λ at the second radio frequency/4 are disposed in the vicinity of the speaker, the portable wireless communication apparatus 10 is capable of lowering the local average SAR in the vicinity of the user's ear in use, thereby securely reducing an amount of electromagnetic waves absorbed by a human body.

(2) Second Embodiment

Figure 4:
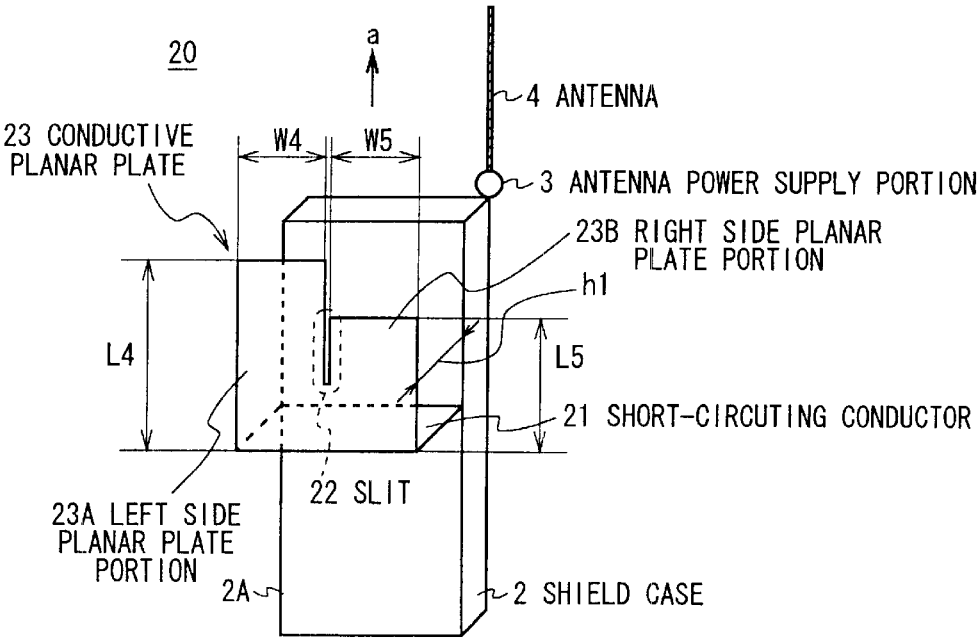
FIG. 4 is a schematic perspective view of showing a configuration of a portable wireless communication apparatus according to a second embodiment of the present invention.

In FIG. 4 in which members corresponding to those shown in FIG. 3 are denoted by the same reference numerals, reference numeral 20 denotes a portable wireless communication apparatus as a whole according to a second embodiment of the present invention. Description will be made below also on an assumption that the hot spot at which the local average SAR has a maximum value is located in the vicinity of an ear which is to be brought into contact with a speaker (not shown).

The portable wireless communication apparatus 20 uses a conductive planar plate 23 disposed at a location which is nearly in parallel with a top surface 2A of a shield case 2 and at a height h1 as measured from the above described top surface 2A, and the above described conductive planar plate 23 is short-circuited to the shield case 2 by a shoring conductor 21.

The conductive planar plate 23 is configured as a single plate consisting of a rectangular left side planar plate portion 23A having a distance L4 as measured from a short-circuited end to an open end and a width W4 at the above described open end, and a right side planar plate portion 23B having a distance L5 as measured from a short-circuited end to an open end and a width W5 at the above described open end which are jointed nearly at a center.

In this case, however, the conductive planar plate 23 has a slit 22 having a predetermined length as measured from a side of the open end which is disposed between the left side planar plate portion 23A and the right side planar plate portion 23B so that the left side planar plate portion 23A and the right side planar plate portion 23B easily move independently.

The distance L4 as measured from the short-circuited end to the open end of the left side planar plate portion 23A of the conductive planar plate 23 is selected, for example, so as to be a wavelength λ at 900 MHz which is a first radio communication frequency/4.

Furthermore, the distance L5 as measured from the short-circuited end to the open end of the right side planar plate portion 23B of the conductive planar plate 23 is selected, for example, so as to be a wavelength λ at 1.8 GHz which is a second radio communication frequency/4.

Accordingly, the portable wireless communication apparatus 20 is capable of bringing input impedance at the open end of the conductive planar plate 23 close to infinity at the first radio frequency (900 MHz) owing to a function of the left side planar plate portion 23A of the conductive planar plate 23.

Similarly, the portable wireless communication apparatus 20 is capable of bringing input impedance at the open end of the conductive planar plate 23 close to infinity at the second radio frequency (1.8 GHz) owing to a function of the right side planar plate portion 23B of the conductive planar plate 23.

Accordingly, the portable wireless communication apparatus 20 is configured to bring input impedance at the open ends of the left side planar plate portion 23A and the right side planar plate portion 23B of the conductive planar plate 23 close to infinity at the first radio frequency (900 MHz) and the second radio frequency (1.8 GHz), thereby being capable of making a high-frequency current hardly supplied from an antenna power supply portion 3 to the above described conductive planar plate 23 and the shield case 2, reducing an amount of electromagnetic waves emitted from the conductive planar plate 23 and the shield case 2 and lowering the local average SAR in the vicinity of a user's ear.

The portable wireless communication apparatus 20 having the above described configuration is capable of bringing the input impedance at the open ends of the left side planar plate portion 23A and the right side planar plate portion 23B of the conductive planar plate 23 close to infinity at the first radio frequency and the second radio frequency since the conductive planar plate 23 which has the left side planar plate portion 23A having the distance L4 as measured from the short-circuited end to the open end selected so as to be the wavelength λ at the first radio frequency (900 MHz)/4 and the right side planar plate portion 23B having the distance L5 as measured from the short-circuited end to the open end selected so as to be the wavelength λ at the second radio frequency (1.8 GHz)/4 is disposed at the location which is nearly in parallel with the top surface 2A of the shield case 2 and at the height h1 as measured from the above described top surface 2A.

As a result, the portable wireless communication apparatus 20 is capable of reducing an amount of electromagnetic waves emitted from the conductive planar plate 23 and the shield case 2 at the first radio frequency and the second radio frequency, thereby lowering the local average SAR in the vicinity of the ear.

Even in a case where the local average SAR is actually measured at a measuring frequency of 1.785 GHz which is close to the second radio communication frequency as shown in FIG. 5B, the portable wireless communication apparatus 20 makes the local average SAR lower than that in a case where the conductive planar plate 23 is not disposed.

It is therefore considered that the portable wireless communication apparatus 20 does not allow the left side planar plate portion 23A which corresponds to the first radio communication frequency to function at the second radio communication frequency and the portable wireless communication apparatus 20 is capable of securely lowering the local average SAR in the vicinity of the ear not only at the first radio communication frequency but also at the second radio communication frequency.

Furthermore, the portable wireless communication apparatus 20 can be configured compact and simple in a configuration without being complicated or enlarged since the portable wireless communication apparatus 20 uses the conductive planar plate 23 which is configured as the single plate consisting of the left side planar plate portion 23A and the right side planar plate portion 23B.

The portable wireless communication apparatus 20 having the above described configuration is capable of lowering the local average SAR in the vicinity of the user's ear in use at the first radio frequency and the second radio frequency, thereby securely reducing an amount of electromagnetic waves to be absorbed by a human body since the planar plate 23 which has the left side planar plate portion 23A having the distance L4 as measured from the short-circuited end to the open end selected so as to be the wavelength λ at the first radio frequency/4 and the right side planar plate portion 23B having the distance L4 as measured from the short-circuited end to the open end selected so as to be the wavelength λ at the second radio frequency/4 is disposed in the vicinity of the speaker.

(3) Other Embodiments

Though each of the conductive planar plates 11 and 23 used as high-frequency current restricting means is configured as the single plate in the above described first and second embodiments, the present invention is not limited by these embodiments and the conductive planar plate can be configured as two plates which are completely separated into a left side planar plate portions 11A and 23A functioning as a shield plate and a right side planer plate portions 11B and 23B functioning as a shield plate.

Though the conductive planar plate 11 which has no slit disposed between the left side planar plate portion 11A and the right side planar plate portion 11B is used in the above described first embodiment, the present invention is not limited to the embodiment and the conductive planar plate 11 can have a slit which is formed for a predetermined length from the open end of the conductive planar plate 11.

In this case, it has been experimentally proved that the conductive planar plate 11 which has such a slit remarkably lowers the local average SAR (on the order of approximately 15%) as compared with the conductive planar plate 11 which has no slit as shown in FIG. 5C when the local average SAR is measured at a measuring frequency of 1.785 GHz close to the second radio communication frequency.

Furthermore, though the conductive planar plate 23 which has the slit 22 disposed between the left side planar plate portion 23A and the right side planar plate portion 23B is used in the above described second embodiment, the present invention is not limited to the embodiment and a conductive planar plate which has no slit disposed between the left side planar plate portion 23A and the right side planar plate portion 23B can be used.

In this case, it has been experimentally proved that a conductive planar plate which has no slit can provide the local average SAR equal to that available with the conductive planar plate 23,which has a slit as shown in FIG. 5D when the local average SAR is measured at a measuring frequency of 1.785 GHz close to the second radio communication frequency.

Furthermore, though the conductive planar plates 11 and 23 are disposed in the vicinities of the speakers in the above described first and second embodiments, the present invention is not limited to the embodiments and the conductive planar plates 11 and 23 can be disposed at other various locations so far as the locations are in the vicinities of hot spots which are to be brought close to human bodies.

Furthermore, though the left side planar portions 11A and the 23A corresponding to the first radio communication frequency are disposed on a left side, and the right side planar plate portions 11B and 23B are disposed on a right side of the top surface 2A of the shield case 2 in the above described first and second embodiments, the present invention is not limited to the embodiments and the left side planar plate portions 11A and the 23A can be exchanged with the right side planar plate portions 11B and 23B.

Furthermore, though the no member is disposed between the top surface 2A of the shield case 2 and the conductive planar plates 11 and 23 in the above described first and second embodiments, the present invention is not limited to the embodiments and a dielectric having a predetermined dielectric constant can be disposed between the top surface 2A of the shield case 2 and the conductive planar plates 11 and 23. In this case, the distance as measured from the short-circuited end to the open end of the conductive planar plates 11 and 23 can be shortened owing to a wavelength shortening effect which is obtained dependently on the dielectric constant of the dielectric.

When a dielectric is used, the distances L2 and L4 as measured from the short-circuited end to the open end of the left side planar plate portions 11A and 23A are expressed by the following formulae:

$$L2 = \frac{\lambda 1}{4} \times \frac{1}{\sqrt{\varepsilon_r}} \tag{1}$$

($\epsilon_\gamma$: a dielectric constant of a dielectric, $\lambda 1$: a wavelength at 900 MHz)

$$L4 = \frac{\lambda 2}{4} \times \frac{1}{\sqrt{\varepsilon_r}} \tag{2}$$

($\epsilon_{65}$ : a dielectric constant of a dielectric, $\lambda 2$: a wavelength at 1.8 GHz)

Though the open ends of the conductive planar plates 11 and 23 are disposed at locations on a side of an upstream end of the shield case 2 in the above described first and second embodiments, the present invention is not limited to the embodiments and the open ends of the conductive planar plates 11 and 23 can be disposed at locations other than locations on the side of the upstream end so far as the locations are in the vicinities of the antenna power supply portion 3 which supplies the high-frequency current.

Though the conductive planar plate 11 which consists of the left side planar late portion 11A and the right side planar plate portion 11B corresponding to the first radio communication frequency and the second radio communication frequency respectively, and the conductive planar plate 23 which consists of the left side planar plate portion 23A and the right side planar plate portion 23B are disposed in the above described first and second embodiment, the present invention is not limited to the embodiments, and a conductive planar plate which consists of a left side planar plate portion, a middle planar plate portion and a right side planar plate portion corresponding to three kinds of radio communication frequencies or a conductive planar plate corresponding to a kind of radio communication frequency can be disposed.

While there has been described in connection with the preferred embodiments of the invention, it will be obvious to those skilled in the art that various changes and modifications may be aimed, therefore, to cover in the appended claims all such changes and modifications as fall within the true spirit and scope of the invention.

What is claimed is:

1. An antenna device functioning as an antenna by supplying electric power to an antenna element from a power supply point for reducing an amount of electromagnetic waves absorbed by a user, said device comprising:

high-frequency current restricting means including:

a first conductive planar plate having a first short-circuit portion with one end electrically short-circuited to a shield case connected to high-frequency currents from said power supply point and a first open end portion with an other end being electrically opened and positioned outside of said shield case to bring an input impedance close to infinity at first radio communication frequencies; and a second conductive planar plate having a second short-circuit portion with one end electrically short-circuited to said shield case and a second open end portion with the other end being electrically opened and positioned outside of said shield case to bring an input impedance close to infinity at second radio communication frequencies, wherein said first conductive planar plate and said second conductive planar plate are composed as one unit.

2. The antenna device according to claim 1 wherein said high-frequency current restricting means further comprises a slit having a predetermined length disposed between said first conductive planar plate and said second conductive planar plate.

3. The antenna device according to claim 1 wherein lengths from the one end to the other end of said first conductive planar plate and said second conductive planar plate, respectively, are substantially equal to ¼ of wavelengths of said first radio communication frequencies and said second radio communication frequencies.

4. The antenna device according to claim 1 wherein said high-frequency current restricting means includes a dielectric having a predetermined dielectric constant interposed between said first and second conductive planar plates and said grounding conductors.

5. The antenna device according to claim 1 wherein said first and second conductive planar plates of said high-frequency current restricting means are disposed at a location on said grounding conductors at which an amount of electromagnetic waves absorbed by a human body exceeds a predetermined specified value when a high-frequency current is supplied to said grounding conductors.

6. A portable wireless communication apparatus having an antenna device for operating an antenna element and grounding conductors as an antenna by supplying electric power from a power supply point to said antenna element for reducing an amount of electromagnetic waves absorbed by a user, said apparatus comprising:

high-frequency current restricting means including:

a first conductive planar plate having a first short-circuit portion with one end electrically short-circuited to a shield case connected to high-frequency currents from said power supply point and a first open end portion with an other end being electrically opened and positioned outside of said shield case to bring an input impedance close to infinity at first radio communication frequencies; and a second conductive planar plate having a second short-circuit portion with one end electrically short-circuited to said shield case and a second open end portion with an outer end being electrically opened and positioned outside of said shield case to bring an input impedance close to infinity at second radio communication frequencies, wherein said first conductive planar plate and said second conductive planar plate are composed as one unit.

7. The portable wireless communication apparatus according to claim 6 wherein said high-frequency current restricting means further comprises a slit having a predetermined length disposed between said first conductive planar plate and said second conductive planar plate.

8. The portable wireless communication apparatus according to claim 6 wherein lengths from the one end to the other end of said first conductive planar plate and said second conductive planar plate, respectively, are substantially equal to ¼ of wavelengths of said first radio communication frequencies and said second radio communication frequencies.

9. The portable wireless communication apparatus according to claim 6 wherein said high-frequency current restricting means includes a dielectric having a predetermined dielectric constant interposed between said first and second conductive planar plates and said grounding conductors.

10. The portable wireless communication apparatus according to claim 6 wherein said first and second conductive planar plates of said high-frequency current restricting means are disposed at a location on said grounding conductors at which an amount of electromagnetic waves absorbed by a human body exceeds a predetermined specified value when high-frequency currents are supplied to said grounding conductors.

11. The portable wireless communication apparatus according to claim 6 wherein said first and second conductive planar plates of said high-frequency current restricting means are disposed adjacent a speaker used in said portable wireless communication apparatus.

* * * * *